US012221889B2

(12) United States Patent
Xin et al.

(10) Patent No.: US 12,221,889 B2
(45) Date of Patent: Feb. 11, 2025

(54) MINE COOLING AND DEHUMIDIFYING SYSTEM

(71) Applicant: SHANDONG UNIVERSITY OF SCIENCE AND TECHNOLOGY, Qingdao (CN)

(72) Inventors: Song Xin, Qingdao (CN); Shangxiao Liu, Qingdao (CN); Wanrong Xu, Qingdao (CN); Shurong Lei, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 18/757,706

(22) Filed: Jun. 28, 2024

(65) Prior Publication Data

US 2025/0012190 A1 Jan. 9, 2025

(30) Foreign Application Priority Data

Jul. 4, 2023 (CN) ..... 202321739296.X

(51) Int. Cl.
*E21F 3/00* (2006.01)
*E21F 1/00* (2006.01)

(52) U.S. Cl.
CPC . *E21F 3/00* (2013.01); *E21F 1/00* (2013.01)

(58) Field of Classification Search
CPC ..... E21F 3/00; E21F 1/00
USPC ..... 62/130
See application file for complete search history.

(56) References Cited

U.S. PATENT DOCUMENTS 11,525,600 B2 * 12/2022 Lee ..... F24F 11/77
2016/0115790 A1 * 4/2016 Millar ..... E21F 1/00 62/401
2024/0011689 A1 * 1/2024 Maruko ..... F25B 49/02

FOREIGN PATENT DOCUMENTS

CN 108548352 A * 9/2018 ..... F24F 11/84
CN 110307028 A * 10/2019 ..... E21F 1/006
EP 4317834 A1 * 2/2024 ..... F25B 1/00

OTHER PUBLICATIONS

Notice of Grant in Corresponding Chinese Application No. 202321739296.X, dated Jan. 15, 2024; 3 pgs.

* cited by examiner

*Primary Examiner* — Avinash A Savani
*Assistant Examiner* — Dana K Tighe
(74) *Attorney, Agent, or Firm* — HAUPTMAN HAM, LLP

(57) ABSTRACT

A mine cooling and dehumidifying system includes a compressor, a gas-liquid separator, an evaporator, a condenser and an expansion valve. The evaporator is in an air supply well, and the condenser is in a return air well; the compressor, the gas-liquid separator and the expansion valve are all between the air supply well and the return air well; an inlet of the compressor is connected to a refrigerant outlet of the evaporator through the gas-liquid separator, and a refrigerant inlet of the evaporator is connected with an outlet of the expansion valve; an inlet of the expansion valve is connected with a refrigerant outlet of the condenser, and a refrigerant inlet of the condenser is connected with an outlet of the compressor. In the present disclosure, by vapor compression type refrigeration cycle, the downhole air heat is transferred to the return air and then discharged to the ground.

6 Claims, 1 Drawing Sheet

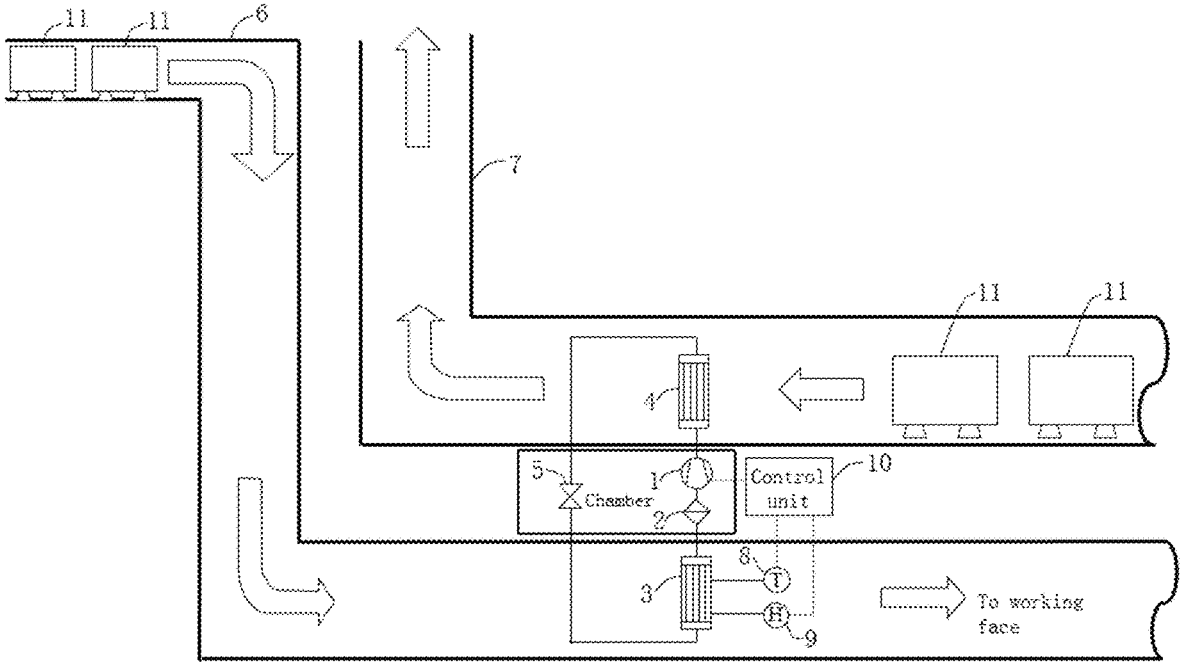
11
11
6
7
11
11
4
5
Chamber
1
2
Control unit
10
8
T
3
H
9
To working face

MINE COOLING AND DEHUMIDIFYING SYSTEM

RELATED APPLICATIONS

The present application claims priority from Chinese Application Number 202321739296.X filed Jul. 4, 2023, the disclosure of which is hereby incorporated by reference herein in its entirety.

TECHNICAL FIELD

The present disclosure relates to the field of mine cooling and dehumidification technologies and in particular to a mine cooling and dehumidifying system.

BACKGROUND

Along with increase of the mining depth of the mineral resources, the downhole temperature and humidity increase accordingly and the heat comfort conditions also gradually drop. Long-time working under high temperature and high humidity will not only lower the working efficiency of the workers but also harm the human health and even cause the problems such as heat stroke and heat shock the like. Therefore, creating comfortable and safe underground working conditions is a basic task of the heat harm treatments in the mines.

At present, the mine heat harm treatment system is mainly to transport cool water through long-distance pipes to the underground by using a large-power refrigeration unit and the energy loss in this transport process is very severe, leading to very low refrigeration efficiency. Furthermore, a large number of pipes need to be arranged in the ventilation wells, bringing high laying costs.

SUMMARY

The object of the present disclosure is to provide a mine cooling and dehumidifying system, so as to solve the technical problems of high energy loss, low refrigeration efficiency and high costs of the mine cooling and dehumidifying system in the prior arts.

In order to solve the above technical problems, the present disclosure employs the following technical solution.

There is provided a mine cooling and dehumidifying system, which includes a compressor, a gas-liquid separator, an evaporator, a condenser and an expansion valve. The evaporator is disposed in an air supply well, and the condenser is disposed in a return air well. The compressor, the gas-liquid separator and the expansion valve are all disposed between the air supply well and the return air well. An inlet of the compressor is connected to a refrigerant outlet of the evaporator through the gas-liquid separator, and a refrigerant inlet of the evaporator is connected with an outlet of the expansion valve. An inlet of the expansion valve is connected with a refrigerant outlet of the condenser, and a refrigerant inlet of the condenser is connected with an outlet of the compressor. With the above structure, the fresh air in the air supply well performs heat exchange with the low-temperature and low-pressure refrigerant in the evaporator when passing through the evaporator, and the refrigerant absorbs the heat of the refresh air and is evaporated into a superheated low-temperature and low-pressure vapor, so as to perform cooling and dehumidification on the fresh air. Subsequently, the refrigerant is compressed by the compressor to a high-temperature and low-pressure state and then enters the condenser to perform heat exchange with the return air to transfer its heat to the return air, and then the transferred heat is carried by the return air to the ground. In the present disclosure, by vapor compression type refrigeration cycle, the downhole air heat is transferred to the return air and then discharged by the return air to the ground. Therefore, there is no need to lay long-distance pipes, reducing the energy loss, increasing the refrigeration efficiency and lowering the costs.

Preferably, a chamber is disposed between the air supply well and the return air well, and the compressor, the gas-liquid separator and the expansion valve are disposed in the chamber. The disposal of the chamber helps dispose the compressor, the gas-liquid separator and the expansion valve.

Preferably, multiple air blowers are disposed in each of the air supply well and the return air well. The disposal of the air blowers can guarantee downhole ventilation.

Preferably, a temperature sensor and a humidity sensor are disposed at an air outlet of the evaporator. The temperature sensor and the humidity sensor are disposed such that a temperature and a humidity of the air outlet of the evaporator can be monitored in real time to monitor an air discharge state of the system and help the system to adjust its working state.

Preferably, the compressor is an electric compressor. A rotation speed of the electric compressor is adjustable and thus the rotation speed of the electric compressor can be adjusted based on the temperature and the humidity of the air outlet of the evaporator, so as to satisfy the downhole working requirements.

Preferably, the mine cooling and dehumidifying system further includes a control unit connected with the temperature sensor, the humidity sensor and the compressor.

Preferably, the control unit is connected with the temperature sensor, the humidity sensor and the compressor through cables. The control unit may monitor, in real time, the air outlet temperature and humidity of the evaporator by using the temperature sensor and the humidity sensor, and control the rotation speed of the compressor based on the measured air outlet temperature and humidity of the evaporator.

After the above technical solution is used, the present disclosure has the following beneficial effects.

1. The refrigeration equipment of the present disclosure is located underground to avoid energy loss resulting from transport of the cooling quantity generated above ground to underground, increasing the refrigeration efficiency.

2. In the present disclosure, the condenser is placed in the return air well and the evaporator is placed in the air supply well; the evaporator performs cooling and dehumidification on fresh air and the condenser transfers the heat to the return air and then the heat is carried to the ground by the return air. In the present disclosure, the downhole heat is carried away by using the flowing characteristics of the return air without consuming heat dissipation energy. Moreover, due to a short distance between the return air well and the air supply well, energy loss in the flow process of the refrigerant can be minimized and capital investment for laying long-distance pipes can also be reduced.

3. In the present disclosure, the compressor, the gas-liquid separator, and the expansion valve are placed in the chamber, simplifying the system arrangement and reducing the influence on the downhole operations.

BRIEF DESCRIPTIONS OF THE DRAWINGS

FIG. 1 is a structural schematic diagram illustrating a mine cooling and dehumidifying system according to the present disclosure.

Numerals of the drawings are described below: 1. compressor, 2. gas-liquid separator, 3. evaporator, 4. condenser, 5. expansion valve, 6. air supply well, 7. return air well, 8. temperature sensor, 9. humidity sensor, 10. control unit and 11. air blower.

DETAILED DESCRIPTIONS OF EMBODIMENTS

The present disclosure is further set forth below in combination with the drawings.

The orientations involved in the specification are all based on an orientation of a mine cooling and dehumidifying system in a normal working state in the present disclosure, and its orientations at the time of storage and transportation are not limited and only indicate a relative positional relationship rather than an absolute positional relationship.

As shown in FIG. 1, there is provided a mine cooling and dehumidifying system, which includes a compressor 1, a gas-liquid separator 2, an evaporator 3, a condenser 4 and an expansion valve 5. The evaporator 3 is disposed in an air supply well 6, and the condenser 4 is disposed in a return air well 7. The compressor 1, the gas-liquid separator 2 and the expansion valve 5 are all disposed between the air supply well 6 and the return air well 7. An inlet of the compressor 1 is connected to a refrigerant outlet of the evaporator 3 through the gas-liquid separator 2, and a refrigerant inlet of the evaporator 3 is connected with an outlet of the expansion valve 5. An inlet of the expansion valve 5 is connected with a refrigerant outlet of the condenser 4, and a refrigerant inlet of the condenser 4 is connected with an outlet of the compressor 1. The compressor 1, the condenser 4, the expansion valve 5, the evaporator 3 and the gas-liquid separator 2 are connected through refrigerant pipes. A refrigerant circulates in the compressor 1, the condenser 4, the expansion valve 5, the evaporator 3 and the gas-liquid separator 2 and the refrigerant pipes connecting these components. The evaporator 3 is an air-cooled evaporator for heat exchange between fresh air and the refrigerant, which is disposed in the air supply well. The condenser 4 is an air-cooled condenser for heat exchange between return air and the refrigerant, which is disposed in the return air well. During use, the fresh air in the air supply well 6 performs heat exchange with the low-temperature and low-pressure refrigerant in the evaporator 3 when passing through the evaporator 3, and the refrigerant absorbs the heat of the refresh air and is evaporated into a superheated low-temperature and low-pressure vapor, so as to perform cooling and dehumidification on the fresh air. Subsequently, the refrigerant is compressed by the compressor 1 to a high-temperature and low-pressure state and then enters the condenser 4 to perform heat exchange with the return air to transfer its heat to the return air, and then the transferred heat is carried by the return air to the ground. In the present disclosure, by vapor compression type refrigeration cycle, the downhole air heat is transferred to the return air and then discharged by the return air to the ground.

As a preferred embodiment of the present disclosure, a chamber is disposed between the air supply well 6 and the return air well 7, and the compressor 1, the gas-liquid separator 2 and the expansion valve 5 are disposed in the chamber. The disposal of the chamber helps dispose the compressor 1, the gas-liquid separator 2 and the expansion valve 5.

A temperature sensor 8 and a humidity sensor 9 are disposed at an air outlet of the evaporator 3. The temperature sensor 8 and the humidity sensor 9 are disposed such that a temperature and a humidity of the air outlet of the evaporator 3 can be monitored in real time to monitor an air discharge state of the system and help the system to adjust its working state.

In order to help control a humidity and a temperature of the fresh air, the compressor 1 is an electric compressor. A rotation speed of the electric compressor is adjustable and thus the rotation speed of the electric compressor can be adjusted based on the temperature and the humidity of the air outlet of the evaporator 3, so as to satisfy the downhole working requirements.

The mine cooling and dehumidifying system further includes a control unit 10 connected with the temperature sensor 8, the humidity sensor 9 and the compressor 1. The control unit 10 is connected with the temperature sensor 8, the humidity sensor 9 and the compressor 1 through cables. The control unit 10 may monitor, in real time, the air outlet temperature and humidity of the evaporator 3 by using the temperature sensor 8 and the humidity sensor 9, and control the rotation speed of the compressor 1 based on the measured air outlet temperature and humidity of the evaporator 3. Specifically, when the air outlet temperature and humidity are lower than corresponding set thresholds, the rotation speed of the compressor is lowered; if the air outlet temperature and humidity are greater than the corresponding set thresholds, the rotation speed of the compressor 1 is increased.

As a preferred embodiment of the present disclosure, multiple air blowers 11 are disposed in each of the air supply well 6 and the return air well 7. The disposal of the air blowers 11 can guarantee downhole ventilation.

When the mine cooling and dehumidifying system works, the refresh air in the air supply well 6 performs heat exchange with the low-temperature and low-pressure refrigerant in the evaporator 3 when passing through the evaporator 3, and the refrigerant absorbs the heat of the fresh air and is evaporated into a superheated low-temperature and low-pressure vapor. In this process, the temperature of the fresh air is lowered. When the temperature of the fresh air is lowered to a dew point temperature, the water vapor in the air separates out and changes into liquid water which is discharged through ditch. In this process, the humidity of the fresh air is reduced. Next, the refrigerant is compressed by the compressor 1 to a high-temperature and high-pressure state and then enters the condenser 4 to perform heat exchange with the return air, and transfer its heat to the return air, and then the transferred heat is carried by the return air to the ground. The refrigerant then enters the expansion valve 5 and is depressurized to a low-pressure and low-temperature state. The low-temperature and low-pressure refrigerant enters the evaporator 3 to continue absorbing heat and so on. In the present disclosure, by vapor compression type refrigeration cycle, the downhole air heat is transferred to the return air and then discharged to the ground by the return air. Therefore, there is no need to lay long-distance pipes, reducing the energy loss, increasing the refrigeration efficiency and lowering the costs.

Of course, the above descriptions are not used to limit the present disclosure and the present disclosure is also not limited to the above examples. All changes, variations, additions or substitutions made by those skilled in the arts within the essence scope of the present disclosure shall all fall within the scope of protection of the present disclosure.

The invention claimed is:

1. A mine cooling and dehumidifying system, comprising a compressor, a gas-liquid separator, an evaporator, a condenser and an expansion valve, wherein the evaporator is disposed in an air supply well, and the condenser is disposed in a return air well; the compressor, the gas-liquid separator and the expansion valve are all disposed between the air supply well and the return air well; an inlet of the compressor is connected to a refrigerant outlet of the evaporator through the gas-liquid separator, and a refrigerant inlet of the evaporator is connected with an outlet of the expansion valve; an inlet of the expansion valve is connected with a refrigerant outlet of the condenser, and a refrigerant inlet of the condenser is connected with an outlet of the compressor, wherein a chamber is disposed between the air supply well and the return air well, and the compressor, the gas-liquid separator and the expansion valve are disposed in the chamber.

2. The mine cooling and dehumidifying system of claim 1, wherein multiple air blowers are disposed in each of the air supply well and the return air well.

3. The mine cooling and dehumidifying system of claim 1, wherein a temperature sensor and a humidity sensor are disposed at an air outlet of the evaporator.

4. The mine cooling and dehumidifying system of claim 3, wherein the compressor is an electric compressor.

5. The mine cooling and dehumidifying system of claim 4, further comprising a control unit connected with the temperature sensor, the humidity sensor and the compressor.

6. The mine cooling and dehumidifying system of claim 5, wherein the control unit is connected with the temperature sensor, the humidity sensor and the compressor through cables.

* * * * *